US006354009B1

(12) United States Patent
Belleau

(10) Patent No.: US 6,354,009 B1
(45) Date of Patent: Mar. 12, 2002

(54) PLANER APPARATUS FOR STUCCO WALLS

(76) Inventor: Michael R. Belleau, 34 Hazel St., Salem, MA (US) 01970

( * ) Notice: Subject to any disclaimer, the term of this patent is extended or adjusted under 35 U.S.C. 154(b) by 0 days.

(21) Appl. No.: 09/407,452

(22) Filed: Sep. 28, 1999

Related U.S. Application Data

(63) Continuation-in-part of application No. 09/338,398, filed on Jun. 22, 1999.

(51) Int. Cl.[7] ..... B27C 1/10
(52) U.S. Cl. ..... 30/475; 30/124; 30/306
(58) Field of Search ..... 30/123, 124, 133, 30/276, 277.4, 292, 319, 365, 366, 475, 306; D8/67

(56) References Cited

U.S. PATENT DOCUMENTS 1,281,207 A * 10/1918 Richens ..... 30/123
1,418,328 A * 6/1922 Power ..... 30/475
2,264,278 A * 12/1941 Danforth ..... 30/475
D268,475 S * 4/1983 Markwat ..... D8/67
5,287,660 A * 2/1994 Bellati et al. ..... 30/475
5,461,783 A * 10/1995 Henderson ..... 30/124
5,829,145 A * 11/1998 Hughes ..... 30/475

* cited by examiner

*Primary Examiner*—Hwei-Slu Payer
(74) *Attorney, Agent, or Firm*—Don Halgren

(57) ABSTRACT

The present invention comprises a vacuum planer apparatus for the removal of rough debris from a foam sprayed wall to make that wall foam surface into a flat surface. The apparatus includes an elongated housing having a first end and a second end, an arrangement of rotatable cutter blades mounted in the elongated housing and a drive motor arranged to empower the rotatable cutter blades. A support handle is arranged on each end of the housing for pivotable control of the apparatus. A debris suction conduit is arranged at each end of the housing to pick up and remove foam scraped from the sprayed wall by the rotatable blades. A "Y" joint connects each suction conduit at each end of the housing for ducting into a single discharge conduit. The rotatable cutter blades are mounted on a rotatable shaft and the rotatable shaft has a plurality of locking strips arranged adjacent each of the blades to secure each of the blades onto the rotatable shaft.

8 Claims, 5 Drawing Sheets

PLANER APPARATUS FOR STUCCO WALLS

This application is a continuation-in-part of my co-pending U.S. patent application Ser. No. 09/338,398, filed Jun. 22, 1999, which Application is incorporated herein by reference in its entirety.

BACKGROUND OF THE INVENTION

1. Field of the Invention

This invention relates to methods and apparatus for finishing stucco walls, and more particularly to the apparatus useful for planning such stucco walls.

2. Prior Art

Stucco is a building finish that is applied to walls of buildings to make them weatherproof and to have a finished appearance. This polymer-based synthetic stucco prior art has been used primarily in the Southwest and south of the United States as an exterior siding applied to pre-manufactured rigid styrene board. My aforementioned co-pending Application covers a siding which is the spraying of a foam urethane on a wall. This foam urethane is spray-applied in preferably one pass, to provide a thickness of about ¾ of an inch to 6 inches, for continuous bonding between the foam spray and the wall substrate. This monolithic single layer of foam as further described in my above-identified co-pending Patent Application, provides secure bonding to the wall substrate and eliminates subsequent water migration between the wall and that stucco foam application. A skin outer surface is developed on the foam spray. The foam spray may then be planed by a mechanical trimer.

Prior art devices, like that shown in U.S. Design Pat. No. 268,475 shows a handheld frame with an air motor powered twisted blade, for cutting the foam. Unfortunately, air powered motors may have problems with air pressure, and merely cutting the foam, without it's removal, hinders the cutting and planning operation.

It is an object of the present invention to provide a motorized planer that overcomes the problems associated with prior art planers. It is a further object of the present invention, to provide a motorized planer that removes debris from the workplace. It is still a yet further object of the present invention, to provide a planer that is adjustable, clean, safe and efficient to operate on a sprayed-on urethane foam of the present invention.

BRIEF SUMMARY OF THE INVENTION

The present invention involves a motorized planning apparatus for the resurfacing and flattening of an applied urethane foam on a wall substrate. The planning apparatus comprises an elongated housing having a sidewardly facing extension arranged off of each end thereof. Each sidewardly facing extension has an operator-supported handlebar adjustably arranged thereon. The planning apparatus is arranged to be carried and manipulated by an operator holding the handlebars, one handlebar in each hand. The handlebars are supported on the rear or the operator side of the housing. An electric motor is attached to a motor support extending off of the rear side of the housing. The electric motor is attached via a gear mechanism, to a drive shaft. The drive shaft is supported in a plurality of bearings, parallel to the rear side of the housing. An arrangement of shaft guards or shields encloses the shaft with respect to the housing. The distal end of the drive shaft has a drive pulley thereon.

An elongated foam cutter shaft is rotatably supported within the elongated housing. The elongated cutter shaft has a driven pulley in alignment with the drive pulley on the distal end of the drive shaft. The drive pulley and the drive driven pulley have a belt or link (therebetween so that rotation of the drive pulley rotates the driven pulley and the cutter shaft. The cutter shaft is hexagonal in cross sectional configuration. A plurality of elongated blades extends radially outwardly from the longitudinal axis of rotation of the cutter shaft. Each of the blades is held in radial alignment on the cutter shaft, by a locking strip arranged between adjacent blades. The locking strip is trapezoidal in cross section, so as to meet appropriately along its nonparallel edges, with the adjacent cutter blades. The locking strip is secured to the cutter shaft by a plurality of attachment bolts. Adjacent pairs of trapezoidal locking strips pinch the blades therebetween, and hold the blades closely to the shaft. The distalmost edge of each cutter blade has a plurality of spaced apart serrations thereon, the adjacent blades each having their serrations out of alignment with one another, so as to not effect the smooth cutting operation of the foam as the cutter rotates.

Each end of the housing also comprises a wall engaging lobe edge thereon. The cutter shaft is supported between the opposed lobe edges at each end of the housing. The contour of each lobe edge is such that as the housing is pivoted about its longitudinal axis between the lobe edges, this effects the arcuate pivoting of the cutter blades towards and away from the wall surface. This pivoting movement effects the amount (depth) of removal of the urethane foam from its roughened condition on the wall surface, as desired by the apparatus operator.

The urethane foam, as it is chipped away from the roughened surface against the wall, generates debris that is sucked up through a plenum chamber attached onto the upper side of the housing. The debris is drawn through a suction hose at each end of that housing. The split or paired suction hoses meet at a "Y" junction, which is intended to be disposed behind the operator. The "Y" junction has a single discharge conduit therefrom, which extends to a suction pump and collection tank, for receiving and containing a urethane foam debris as it is removed by the cutter blades and suctioned into the collection tank.

The operator controls the operation of the planer apparatus by a pair of triggers, one adjacent each handlebar at each end of the device.

Operation of the present vacuum planer apparatus permits a device operator to move the device down a foam sprayed surface from an upper portion thereof, flattening out that rough sprayed surface as it goes, the wall engaging lobe edges of the frame ride upon the intended surface, to effect a flattened resultant foam layer therebehind. The combination of the rotating flat blades scraping and cutting against the sprayed surface, and the split suction hose arrangement to withdraw debris, permits a flattened urethane foam wall to be fabricated with minimum inconvenience to the environment and to the builder.

The invention thus comprises a vacuum planer apparatus for the removal of rough debris from a foam sprayed wall to make that wall foam surface into a flat surface, comprising: an elongated housing having a first end and a second end; an arrangement of rotatable cutter blades mounted in the elongated housing; a drive motor arranged to empower the rotatable cutter blades; a support handle arranged on each end of the housing for pivotable control of the apparatus; and a debris suction conduit arranged at each end of the housing to pick up and remove foam scraped from the sprayed wall by the rotatable blades. The invention includes a "Y" joint connecting each the suction conduit at each end of the housing, for ducting into a single discharge conduit, the rotatable cutter blades are mounted on a rotatable shaft, the rotatable shaft having a plurality of locking strips arranged adjacent each of the blades to secure each of the blades onto the rotatable shaft, the rotatable shaft may be hexagonal in cross-sectional shape, and the locking strips may be trapezoidal in cross-sectional shape for proper securement of the blades to the rotatable shaft. A collection tank may be arranged for capture of debris from the single discharge conduit. The blades have spaced apart serrations thereon for blade strength. The serrations on adjacent blades are out of alignment with one another for smoothness of the foam cutting and scrapping operation. The invention also includes a method of removing an uneven coating of sprayed urethane foam on a wall substrate to produce a smooth outer layer of foam on the wall, comprising the steps of: arranging an elongated housing with an elongated rotatable cutter blade device with a plurality of blades thereon, the device supported therein; empowering the rotatable cutter blade device to rotate by a motor attached to the housing; attaching an exhaust manifold to the housing to receive and duct away any foam debris generated by the rotatable blades; connecting a vacuum source to the exhaust manifold to effect removal of foam debris from the manifold; actuating the motor to rotate the cutter blades to cut and remove uneven foam from the foam spray on the wall; arranging the exhaust manifold into a pair of conduits to duct debris to the vacuum source; joining the pair of conduits into a common duct at a "Y" junction to duct debris to the vacuum source; placing a plurality of spaced apart serrations on the blades to provide strength thereto; misaligning the serrations on adjacent blades to permit the blades to provide a smooth cut surface on the sprayed foam; securing the blades to the cutter blade device by a plurality of spaced apart elongated strips of trapezoidal cross-sectional shape.

BRIEF DESCRIPTION OF THE DRAWINGS

The objects and advantages of the present invention will become more apparent, when viewed in conjunction with the following drawings in which.

DESCRIPTION OF THE PREFERRED EMBODIMENTS

Figure 1:
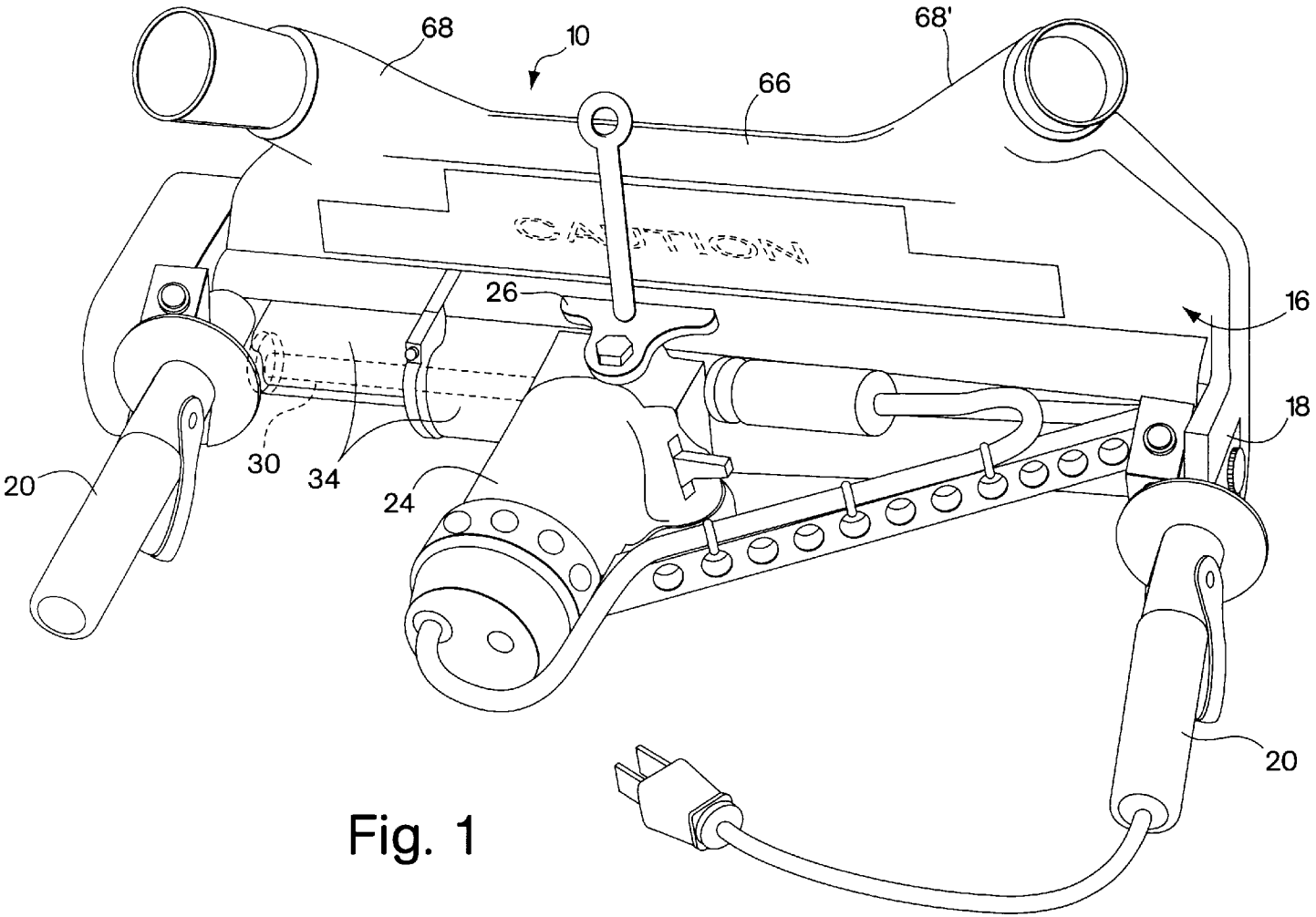
FIG. 1 is a perspective view of a vacuum planer apparatus from its rear quarter.
Figure 2:
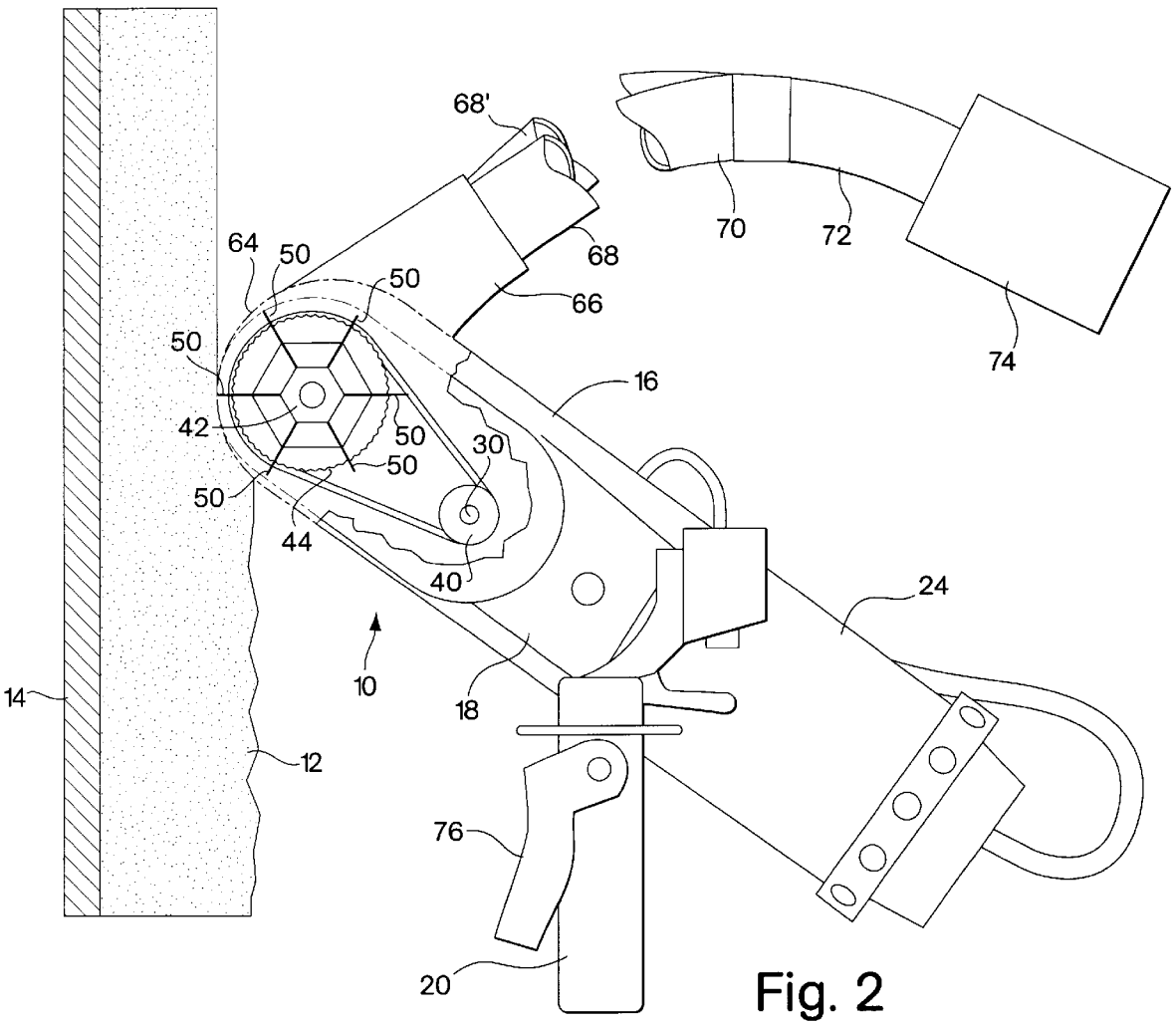
FIG. 2 is a side elevational view of the vacuum planer apparatus in partial section, shown operating against a sprayed wall surface.
Figure 3:
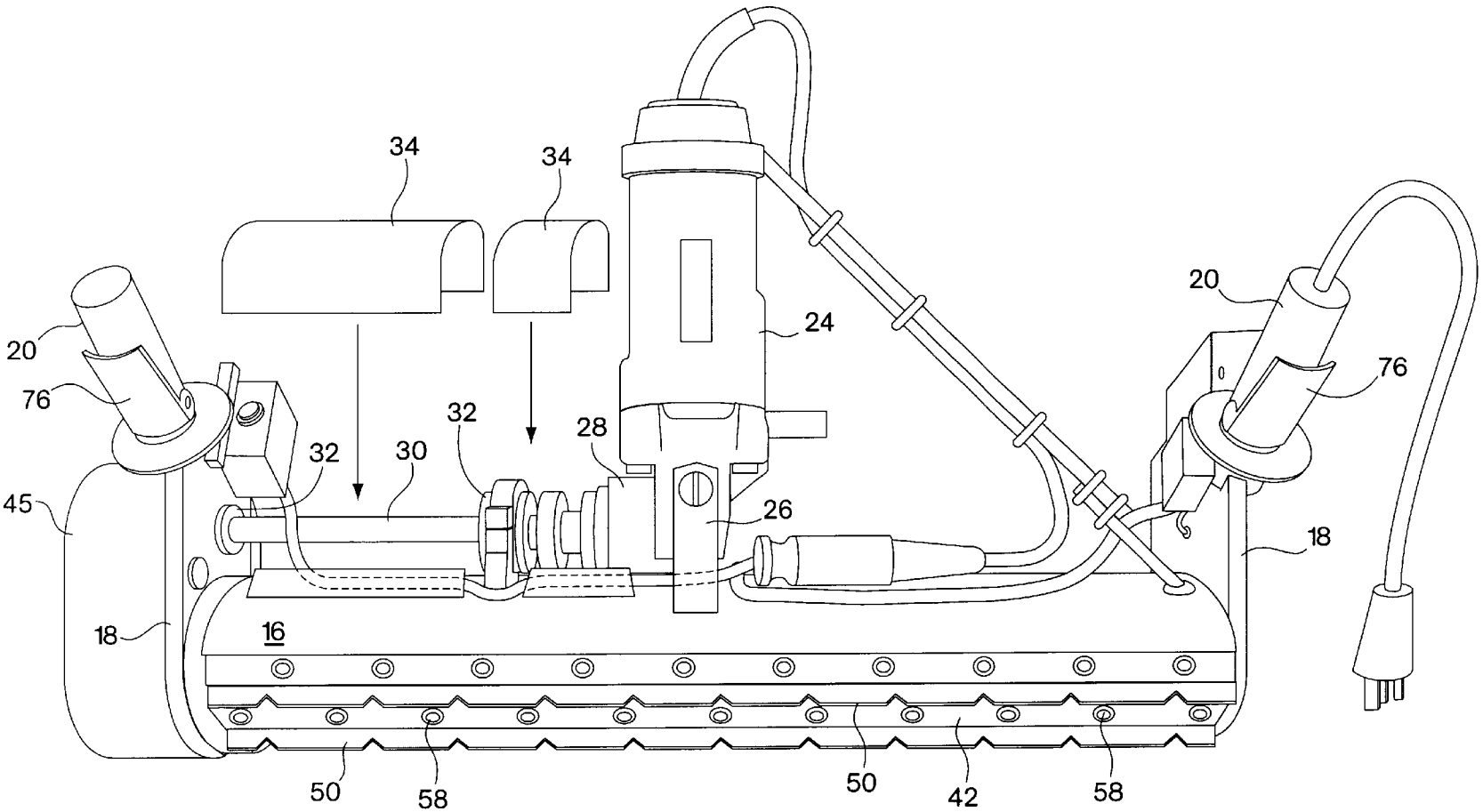
FIG. 3 is a bottom view of the vacuum planer apparatus.

Referring now to the drawings in detail, and particularly to FIG. 1, there is shown the present invention comprising a motorized planning apparatus 10 for the resurfacing and flattening of an applied urethane foam 12 on a wall substrate 14, as shown in FIG. 2. The planning apparatus 10 comprises an elongated housing 16 having a sidewardly facing extension tab 18 arranged off of each end thereof. Each sidewardly facing extension tab 18 has an operator-supported handlebar 20 adjustably arranged thereon. The planning apparatus 10 is arranged to be carried and manipulated by an operator holding both of the handlebars 20, one handlebar 20 in each hand. Each handlebar 20 is supported on the rear or the operator side of the housing 16, as shown in FIGS. 1, 2 and 3. An electric motor 24 is attached to a motor support 26 extending off of the rear side of the housing 16. The electric motor 24 is connected via a gear mechanism 28, to a drive shaft 30. The drive shaft 30 is supported in a plurality of bearings 32, parallel to the rear side of the housing 16. An arrangement of shaft guards or shields 34 encloses the shaft 30 with respect to the housing 16. The distal end of the drive shaft 30 has a drive pulley 40 thereon.

An elongated foam cutter shaft 42 is rotatably supported within the elongated housing 16, as may be seen in FIGS. 2 and 3. The elongated cutter shaft 42 has a driven pulley 44 in alignment with the drive pulley 40 on the distal end of the drive shaft 30, as shown in FIG. 2, and a cover 45 encloses the pulleys 40 and 44. The drive pulley 40 and the driven pulley 44 have a belt or link 46 therebetween so that rotation of the drive pulley 40 rotates the driven pulley 44 and the cutter shaft 42.

Figure 4:
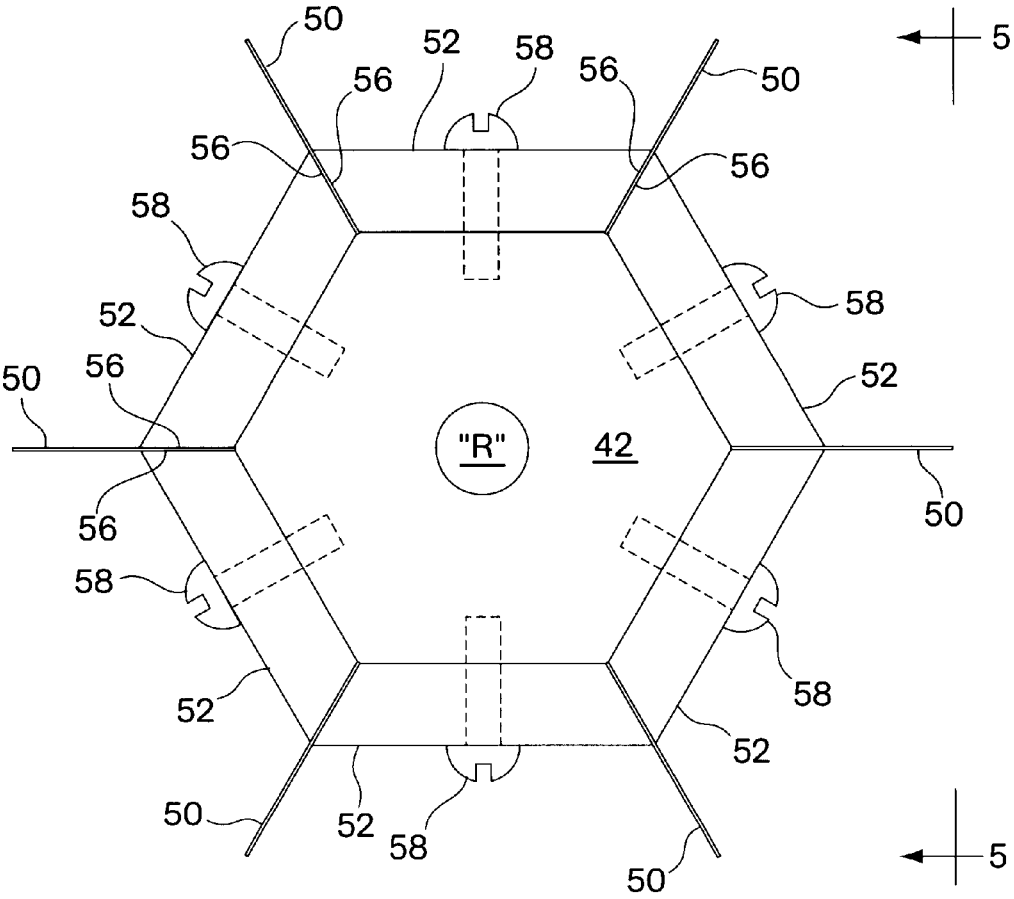
FIG. 4 is an end view of the blade arrangement and cutter shaft of the present invention.
Figure 5:
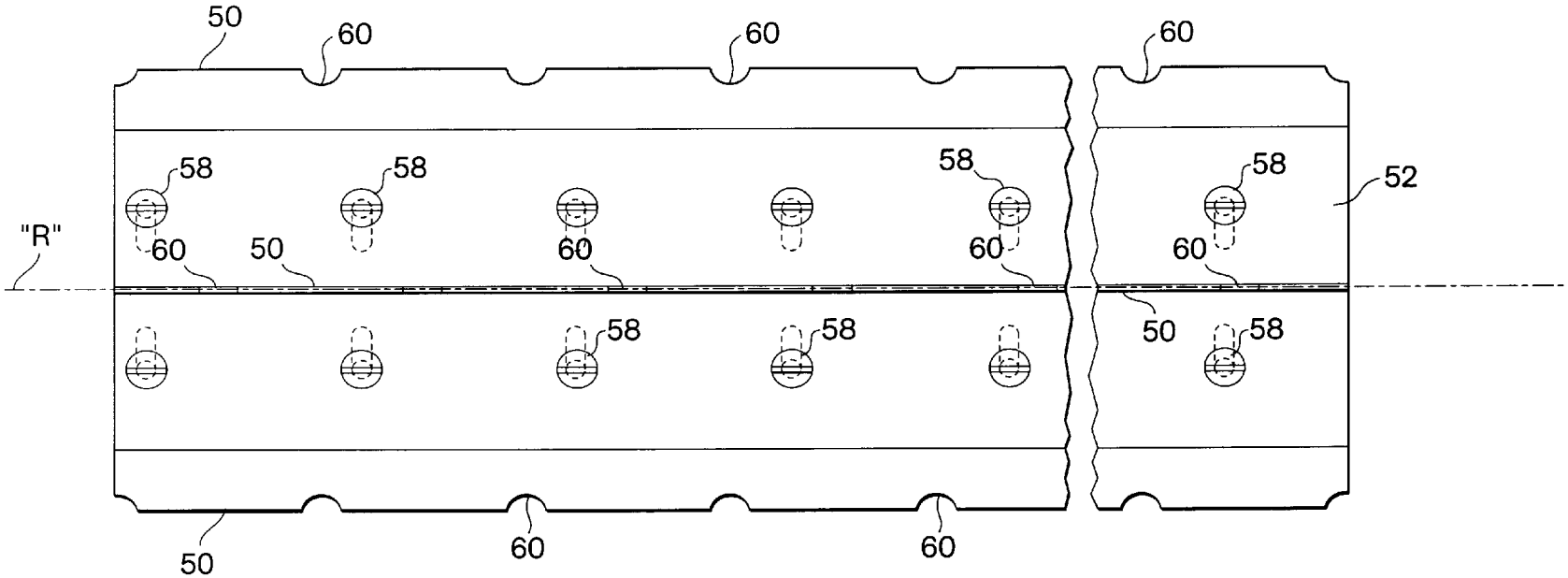
FIG. 5 is a view taken along the lines 5—5 of FIG. 4.

The cutter shaft 42 is hexagonal in cross sectional configuration, as is shown in FIG. 4. A plurality of elongated blades 50 extends radially outwardly from the longitudinal axis of rotation "R" of the cutter shaft 30. Each of the blades 50 is held in radial alignment on the cutter shaft 30 by a locking strip 52 arranged between adjacent blades 50. The locking strip 52 is trapezoidal in cross section as may be seen in FIG. 4, so as to meet appropriately along its nonparallel edges 56, with the adjacent cutter blades 50. Each locking strip 52 is secured to the cutter shaft 30 by a plurality of attachment bolts 58. Adjacent pairs of trapezoidal locking strips 52 pinch the blades 50 therebetween, and hold each of the blades 50 closely to the shaft 30. The distalmost edge of each cutter blade 50 has a plurality of spaced apart serrations 60 thereon, the adjacent blades 50 each having their serrations 60 out of alignment with one another, as may be seen in FIG. 5, so as to not effect the smooth cutting operation of the foam 12 as the cutter shaft 30 rotates.

Each end of the housing 16 also comprises a wall/foam engaging lobe edge 64 thereon. The cutter shaft 42 is supported between the opposed lobe edges 64 at each end of the housing 16. The contour of each lobe edge 64 is such that as the housing 16 is pivoted about its longitudinal axis between the lobe edges 64, this effects the arcuate pivoting of the cutter blades 50 towards and away from the wall surface 12. This pivoting movement effects the amount (depth) of removal of the urethane foam 12, from its roughened condition on the wall surface, as represented in FIG. 2, as desired by the apparatus operator. The radial edge of each blade 50 is in alignment with only a short arcuate portion of the lobe edge 64, as shown in FIG. 2 to permit cutting of the foam 12 only during that angular position of the apparatus 10 with the wall and foam 14 and 12 when the blades 50 are permitted to "dig into" the foam 12.

The urethane foam 12 as it is chipped away from the roughened surface against the wall 14, generates debris that is sucked up through a plenum chamber 66 attached onto the upper side of the housing, 16. The debris is drawn through a suction hose 68 and 68' at each end of that housing 16. The split or paired suction hoses 68 and 68' meet at a "Y" junction 70, which is intended to be disposed behind the operator. The "Y" junction 70 has a single discharge conduit 72 therefrom, which extends to a suction pump and collection tank 74, for receiving and containing a urethane foam debris as it is removed by the cutter blades 50 and suctioned into the collection tank 74.

The operator controls the operation of the planer apparatus 10 by a pair of triggers 76 and 78, one adjacent each handlebar 20 at each end of the apparatus 10.

Operation of the present vacuum planer apparatus 10 permits a device operator to move the device down a foam sprayed surface 12 from an upper portion thereof, flattening out that rough sprayed surface as it goes, the wall engaging lobe edges 64 of the housing 16 ride upon the foam surface, to effect a flattened resultant foam layer therebehind, as represented in FIG. 2. The combination of the rotating flat blades 50 scraping and cutting against the sprayed surface foam 12, and the split suction hose 68 and 68' arrangement to withdraw debris, permits a flattened urethane foam wall to be fabricated with minimum inconvenience to the environment and to the builder.

I claim:

1. A vacuum planer apparatus for the removal of rough debris from a foam sprayed wall to make that wall foam surface into a flat surface, comprising:

an elongated housing having a first end and a second end;

an arrangement of rotatable cutter blades mounted in said elongated housing;

a drive motor arranged to empower said rotatable cutter blades; a support handle arranged on each end of said housing for pivotable control of said apparatus; and a debris suction conduit arranged at each end of said housing to pick up and remove foam scraped from said sprayed wall by said rotatable blades.

2. The vacuum planer apparatus for the removal of rough debris from a foam sprayed wall as recited in claim 1, including a "Y" joint connecting each said suction conduit at each end of said housing, for ducting into a single discharge conduit.

3. The vacuum planer apparatus for the removal of rough debris from a foam sprayed wall as recited in claim 2, wherein said rotatable cutter blades are mounted on a rotatable shaft.

4. The vacuum planer apparatus for the removal of rough debris from a foam sprayed wall as recited in claim 3, wherein said rotatable shaft has a plurality of locking strips arranged adjacent each of said blades to secure each of said blades onto said rotatable shaft.

5. The vacuum planer apparatus for the removal of rough debris from a foam sprayed wall as recited in claim 4, wherein said rotatable shaft is hexagonal in cross-sectional shape, and said locking strips are trapezoidal in cross-sectional shape for proper securement of said blades to said rotatable shaft.

6. The vacuum planer apparatus for the removal of rough debris from a foam sprayed wall as recited in claim 2 including a collection tank for capture of debris from said single discharge conduit.

7. The vacuum planer apparatus for the removal of rough debris from a foam sprayed wall as recited in claim 5 wherein said blades have spaced apart serrations thereon for blade strength.

8. The vacuum planer apparatus for the removal of rough debris from a foam sprayed wall as recited in claim 7 wherein said serrations on adjacent blades are out of alignment with one another for smoothness of the foam cutting and scrapping operation.

* * * * *